United States Patent [19]

Williamson et al.

[11] Patent Number: 4,625,198

[45] Date of Patent: Nov. 25, 1986

[54] ALARM SYSTEM DIAGNOSTIC APPARATUS

[75] Inventors: Gary L. Williamson, North Palm Beach; Oscar A. Williamson, Ft. Lauderdale, both of Fla.

[73] Assignee: Self Diagnostic Security Devices, Inc., Riviera Beach, Fla.

[21] Appl. No.: 640,655

[22] Filed: Aug. 14, 1984

[51] Int. Cl.[4] ..... G08B 29/00

[52] U.S. Cl. ..... 340/514; 340/512; 340/513; 340/540

[58] Field of Search ..... 340/514, 513, 512, 515, 340/516, 506, 649–654, 540, 541; 324/133, 158 D, 158 F; 361/245

[56] References Cited

U.S. PATENT DOCUMENTS

| | | | |
|---|---|---|---|
| 3,309,685 | 3/1967 | Manning | 340/513 |
| 3,351,934 | 11/1967 | Vietz | 340/513 |
| 3,611,362 | 10/1971 | Scott | 340/513 |
| 3,668,676 | 6/1972 | Sasaki | 340/514 |
| 3,815,112 | 6/1974 | Kleber | 340/514 |
| 3,924,256 | 12/1975 | Cohen | 340/513 |
| 3,955,183 | 5/1976 | McBrian | 340/514 |
| 4,270,121 | 5/1981 | Verr | 340/514 |
| 4,274,087 | 6/1981 | Swanson et al. | 340/514 |
| 4,394,647 | 7/1983 | Van Dine | 340/651 |
| 4,435,700 | 3/1984 | Alley | 340/512 |

FOREIGN PATENT DOCUMENTS

| | | | |
|---|---|---|---|
| 1265001 | 5/1968 | Fed. Rep. of Germany . | |
| 1566823 | 4/1970 | Fed. Rep. of Germany . | |
| 2038061 | 7/1980 | United Kingdom . | |
| 2137790 | 10/1984 | United Kingdom | 340/514 |

*Primary Examiner*—Donnie L. Crosland
*Attorney, Agent, or Firm*—Steele, Gould & Fried

[57] ABSTRACT

A diagnostic status indicating apparatus is used with an alarm system having a plurality of normally-closed switch contacts which are opened upon occurrence of an alarm condition. Light-emitting diodes are connected across the normally-closed switch contacts at an opposite polarity to that of the current normally passing through the contacts in the operating mode. In order to diagnose the alarm-generating condition of the electrical contacts, a switch removes the operating voltage and connects a test voltage at a reverse polarity, whereupon the LED for any open circuited electrical contact is activated. The device is preferably based upon a double-pole-double-throw switch and includes indicators for a test condition and for a ground fault.

14 Claims, 5 Drawing Figures

ALARM SYSTEM DIAGNOSTIC APPARATUS

BACKGROUND OF THE INVENTION

1. Field of the Invention

This invention relates to the field of alarm systems, and in particular to a means of diagnosing and indicating the status of a plurality of connected sensing contacts, and which of the contacts may be causing an alarm-generating condition.

2. Description of the Prior Art

Alarm systems based upon normally-closed contacts wired in series are well known. The contacts are usually mounted at locations which will be encountered by an intruder or other factor generating an alarm condition. For example, normally-closed limit switches may be serially wired and placed around doors and windows to be secured, opening of any of the doors and windows causing a cessation of current in the alarm network, and generating an alarm. Similar switch apparatus may be mounted on interior doors, under rugs, or may be associated with the relay contacts of light beam and photo cell sensors.

Alarm systems are preferably based upon normally-closed contacts wired in series, rather than normally-open contacts wired in parallel. In this manner, a fault in the wiring connecting the switches, or the deliberate breaking of a connection by an intruder, will generate an alarm condition just as if switch contacts were closed. Moreover, such normally-closed contacts can be combined with easily-broken conductors, for example, metallic tape on windows, fusible conductors for detecting fires, and the like.

A drawback of normally-closed switch and conductor systems is that they require a constant supply of current. In the event that the installation requires protection during a time of disconnection of power, a battery is necessary. Therefore, there may be situations in which a parallel-contact installation or a combination of series and parallel sensors is deemed necessary.

For the most part, prior art systems have been based upon series-wired switches connected to a single annunciator, i.e., an electrically controlled apparatus for producing audible and/or visible signals. The system is thus applicable to produce an alarm condition when any of the series-wired switches is open. A system according to the foregoing description, however, does not indicate which of the plurality of connected switches is the source of the open circuit. The alarm condition may be due to more than one of the switches being open. It is possible to wire both leads of each normally-closed switch to a central location whereby they can be individually tested by sequentially (or simultaneously) attempting to pass a current through the individual switch contacts. The present invention provides the benefits of such a complicated individually-addressable-contact network, in a much simpler way.

According to the invention, the individual contacts are wired in a conventional system in series with one another and with an annunciator. The annunciator is a direct-current-powered device which may operate, for example, by disabling an audible alarm so long as power is applied to the annunciator through the series connected electrical contacts. Each contact is supplied according to the invention with a reverse-biased light-emitting diode ("LED"), and a switch network is operable in a test mode to place a test voltage, at a polarity opposite that of the annunciator in its normal operating mode, across the series-connected contacts. Therefore, any of the contacts which remain open will be indicated by the actuation of the associated LED.

The system according to the invention does not require that the LED indicators for the individual electrical contacts by located at any central location, or be individually tested, although they may be centrally located if deemed advisable. Additional indicators, including a "test condition" indicator in series with the test voltage supply, and a ground fault indicator, running from ground to the test voltage supply, are provided.

The invention is applicable to either an original installation or a retrofit installation with an existing alarm system characterized by series-connected normally-closed switches. In a retrofit, the user need only wire the device of the invention between the annunciator and the series-connected contacts, and connect LED indicators in parallel with the individual contacts as needed. In the event less than all of the series-connected contacts are provided with indicators, the "test condition" indicator is operable to localize the open circuit condition to the portion of the network which does not have indicators.

SUMMARY OF THE INVENTION

It is an object of the invention to provide an inexpensive and effective means of determining the status of individual contacts in an alarm network.

It is also an object of the invention to operate an alarm network in two modes at opposite polarities, one polarity for alarm sensing and indication, and a second polarity for testing.

It is another object of the invention to provide a convenient means of changing between an alarm mode and a test mode in an alarm network.

It is yet another object of the invention to provide mode indication and ground fault indication in connection with a continuity test for an alarm network.

These and other objects are accomplished by a diagnostic indicating apparatus of reversed polarity, used with an alarm system of the type having a plurality of normally-closed switch contacts which are opened upon occurrence of an alarm condition. Light-emitting diodes are connected across the normally-closed switch contacts at a polarity opposite that of the current normally passing through the contacts in the operating mode. In order to diagnose the alarm-generating condition of the electrical contacts, a switch removes the operating voltage and connects a test voltage at a reverse polarity, whereupon the LED for any open-circuited electrical contact is activated. The device is preferably based upon a double-pole-double-throw ("DPDT") switch and includes indicators for a test condition and for a ground fault.

BRIEF DESCRIPTION OF THE DRAWINGS

There are shown in the drawings embodiments that are presently preferred. It should be understood, however, that the invention is not limited to the precise arrangements and instrumentalities shown in the drawings, wherein.

DETAILED DESCRIPTION OF THE PREFERRED EMBODIMENTS

Figure 1:
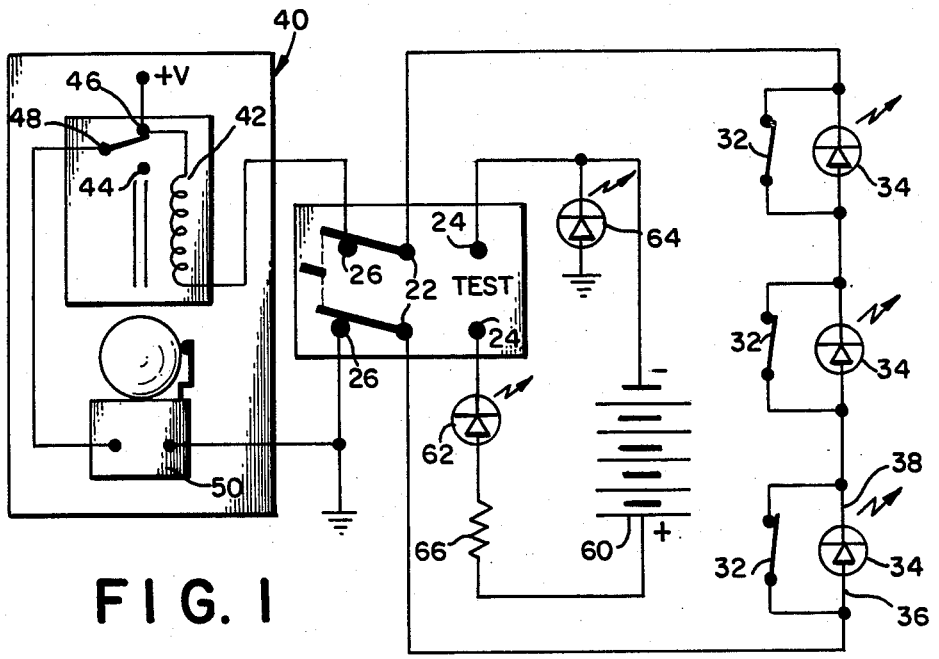
FIG. 1 is a schematic diagram of the alarm system of the invention.

The overall alarm system according to the invention is shown in FIG. 1. A number of electrical contact sets 32 are wired in series, and the opening of any of the electrical contact sets causes generation of an audible alarm, flashing light, siren or the like. The audible alarm is desired in the event that a normally-closed switch becomes opened, that is, when the continuity of the connected switches is broken. Therefore, annunciator unit 40 is operable to sound (or display) the alarm in the event continuity is broken. The annunicator may be driven by an amplifier connected to drive an audible alarm in the event that an open circuit breaks a connection to ground. For purposes of discussion, the device is shown with a relay 42 connected such that the relay coil remains energized so long as continuity is unbroken along switches 32. This is accomplished by placing the relay coil in series with the switches 32, and in parallel with a direct current voltage source (indicated "+V"). So long as the relay remains energized, wiper contact 48 of relay 42 is connected to floating contact 44. In the event continuity is broken, as shown in FIG. 1, wiper 48 connects audible alarm unit 50 to the voltage supply by means of contact 46. Other forms of annunciators are possible as well, provided a direct current is passed through series-connected switches 32 in an operating mode.

According to the invention, the general idea of an alarm which sounds upon breaking of continuity along normally-closed sense switches is improved such that the particular sense switch or switches causing the break in continuity is visually indicated. Moreover, the valid attempt at passage of test current through the sense switch contacts is shown and the existence of any connection to ground in the wiring or in any of the electrical sense switch contacts is indicated as well.

According to the invention, a double-pole-double-throw ("DPDT") switch 20, which may for example be a momentary switch, is operable to disconnect the annunciator 40 from series-connected electrical contacts 32, and to connect a test voltage to the series-connected contacts at the opposite polarity from that of annunciator 40. The series-wired contacts 32 connected between wiper contacts 22 of switch 20, normally connect the minus side of relay 42 in annunciator 40 to ground, thereby energizing the coil. When the test switch is thrown, annunciator 40 is disconnected. Preferably, means are provided to avoid generating a spurious alarm when the annunciator is removed from the circuit by switch 20. This may be accomplished, for example, by using switch 20 to connect the DC voltage supply to the relay in normal operation and to disconnect power from the annunciator in the test mode.

Also according to the invention, each individual electrical contact 32 is wired in parallel with a polar indicator element, for example, a light-emitting diode 34. In the normal or operate mode of the alarm system, light-emitting diodes ("LEDs") 34 are reverse-biased. That is, a more positive voltage is placed on the cathode of 38 of each LED 34 than is placed upon the anode 36 whereby the diode acts to block current passing in one direction only. Therefore, in the operate mode, indicators 34 are not active. In the test mode, however, the polarity of the system is reversed. A DC voltage source, for example, battery 60, is connected by a current-limiting resistor 66 to forward bias the LEDs. Accordingly, should one or more of LEDs 34 be placed across the test voltage source, they will conduct current and will glow.

LEDs 34 are wired in parallel to individual electrical contacts 32, such that so long as electrical contacts 32 remain closed, the associated LED 34 will be shorted out and will not glow, even in the test mode. Current takes the path of least resistance, and in the test mode that path will run through the associated electrical contact 34 if said contact is closed, and through forward-biased LED 34 if the contact is open. In the operate mode, current will pass through contacts 32 or not at all.

Individual LEDs 34 may be located in physical proximity with the electrical contacts with which they are associated. Means are preferably provided to ensure connection at the proper polarity, such that the indicators such as LEDs 34 may be physically packaged together with an electrical contact mechanism 32, for example, a limit switch.

Test mode indicator 62 is also wired in series with the current limiting resistor and the electrical contacts. In the event that there is an open circuit anywhere between DPDT switch 20 and the series-parallel connected electrical contacts 32 and LEDs 34, then current will be blocked and no indication will be provided as to the status of individual electrical contacts 32. Unless some additional means is provided, the user placing the system in the test mode would be unable to determine whether the lack of any glowing in indicators 34 was due to the fact that all the electrical contacts 32 were closed, or that an open circuit had occurred between switch 20 and electrical contacts 32, or in the wiring between electrical contacts 32 themselves. Indicator 62 is provided to indicate whether there is any current whatsoever flowing through the system in the test mode. Therefore, provided indicator 62 is glowing, the user is assured that the lack of any glowing individual LED 34 is due to the fact that there are no open circuits across individual electrical contacts 32.

Ground fault indicator 64 may be placed, for example, between a physical ground (e.g., a water pipe or the like) and the negative terminal of DC voltage source 60. Inasmuch as there is no other ground connection when the system is in the test mode, electrical contacts 32 are normally floating without any reference to ground. LED 64 is operative only to hold the negative side of the system in the test mode at a reference voltage to ground (the usual diode drop is 0.7 volts), whereby the negative terminal will remain slightly negative. In the event a short circuit produces a ground somewhere in the electrical contacts, indicator 64 will be shorted out entirely, and will not glow.

It is also possible to mount a ground fault indicator with reference to the positive side of the DC voltage source 60. The indicator would, of course, have to be placed in the opposite polarity from that indicated for LED 64, that is, biased to conduct toward ground from the positive terminal of DC voltage source 60. Grounding of any of electrical contacts 32 would thereby short out the ground fault indicator.

The system according to the foregoing description can conveniently be packaged as an add-on feature for an existing system. A typical annunciator unit 40 is located in a protected location, and simply wired to the remote electrical switches 32. In installing the unit according to the invention, the user need only disconnect annunciator 40 and connect the DPDT switch and test mode circuitry between annunciator 40 and electrical contacts 32, The user then wires LEDs 34 in parallel with the electrical contacts.

Figure 2:
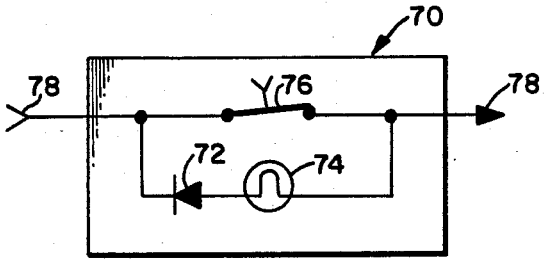
FIG. 2 is a schematic diagram of an alternative embodiment of an electrical contact and individual indicator set.

FIG. 2 illustrates an alternative embodiment for the parallel-connected electrical contact 32 and LED 34 configuration. A separately-packaged unit 70 having dissimilar connectors 78 in order to ensure proper polarity, includes an electrical limit switch contact 76, a conventional diode 72 and a non-polar indicator lamp 74. Lamp 74 may conveniently be a low voltage incandescent lamp.

The brightness of LEDs 34 or incandescent lamp 74 will depend upon how may of them are placed in series across a predetermined test voltage at a given time. When only one of the individual electric contacts 32 is open, and only one LED 34 or incandescent lamp 74 glowing, the LED or lamp will be at its brightest. When all are open, the LEDs or lamps will be relatively dimmer. The particular voltage of DC source 60 and the resistance of current-limiting resistor 66 are chosen such that adequate light will be emitted even at the dimmest condition. LEDs typically have a nominal current requirement of 20 mA. This current is required at the usual forward-biased diode voltage drop of 0.7 volts, that is, a forward resistance for each LED of about 35 ohms. In the usual case, only a relatively small number of individually electrical contacts 32 will be open at a time, for example one. Therefore, current-limiting resistor 66 is chosen to allow one LED 34 and test condition indicator LED 62 to glow brightly. For example, should DC voltage source 60 be a 9-volt battery, current-limiting resistor 66 could be about 300 ohms to achieve a current of 25 mA. The current would be reduced to about 23 mA in the event that 2 of the LEDs 34 were in series, and so on.

Figure 3:
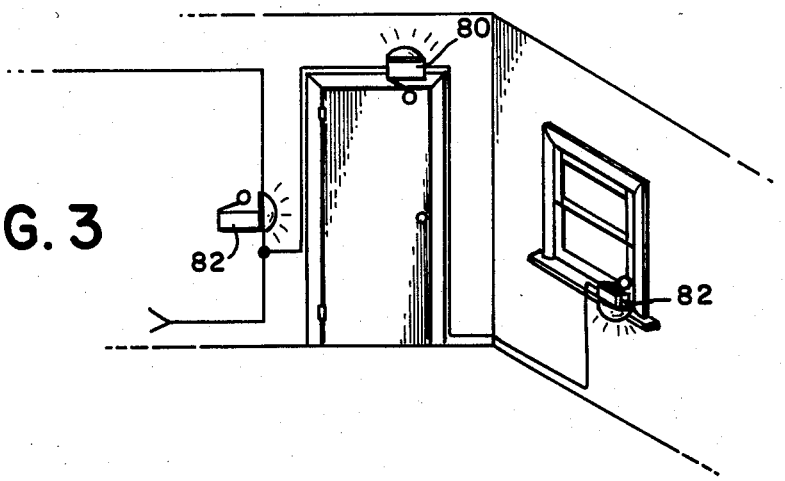
FIG. 3 is a perspective drawing of an installation according to the invention.

As shown in FIG. 3, limit switches and indicator lamps or LEDs can be mounted at window locations 82 and door locations 80. The limit switches may be single pole normally-closed switches mounted such that the limit switch lever or plunger is spring biased against the window or door. The switch opens when the door is opened or the window raised. In the test mode, the user can easily see which of the switches is in an alarm-generating condition, because the associated indicator glows. In the alarm-generating mode, the indicators will not glow even if an alarm condition occurs. Therefore, the intruder or burglar will not be alerted by an indicator to the existence of the switch that detects the alarm condition.

Figure 4:
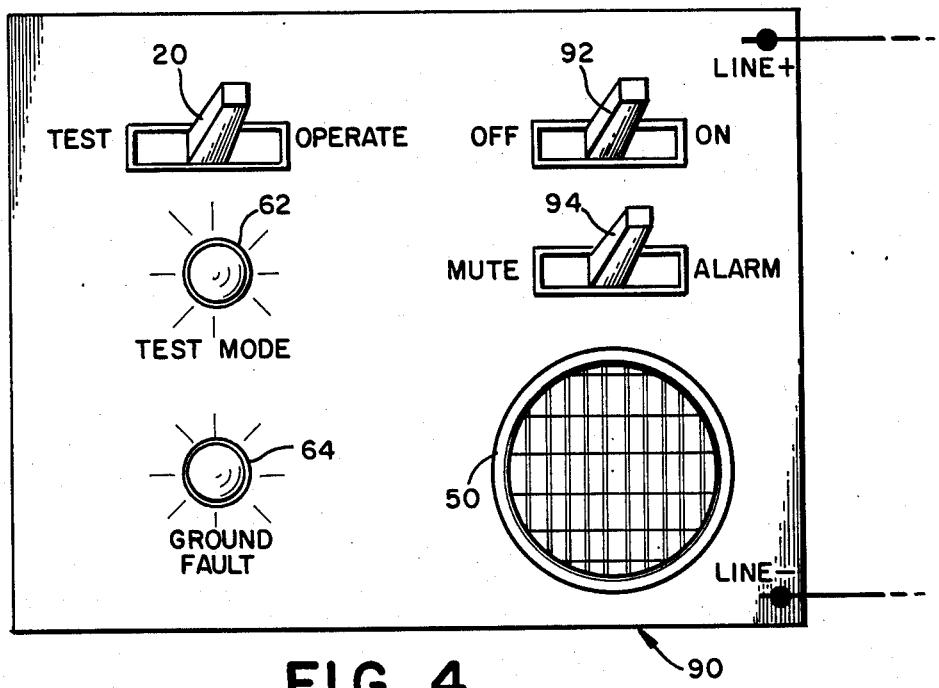
FIG. 4 is a plan view of an alarm system control box according to the invention.

Referring to FIG. 4, the unit according to the invention can be packaged together with the annunciator unit. The unit as shown in FIG. 1, supplemented by an on-off switch 92 and switch means 94 for disabling the audible alarm 50 are packaged in unit 90, and merely wired by means of outgoing lines to the series-connected electrical contacts with their parallel-connected LEDs. Test mode indicator 62 and ground fault indicator 64 are mounted on the face of the unit, as is test-operate switch 20.

Figure 5:
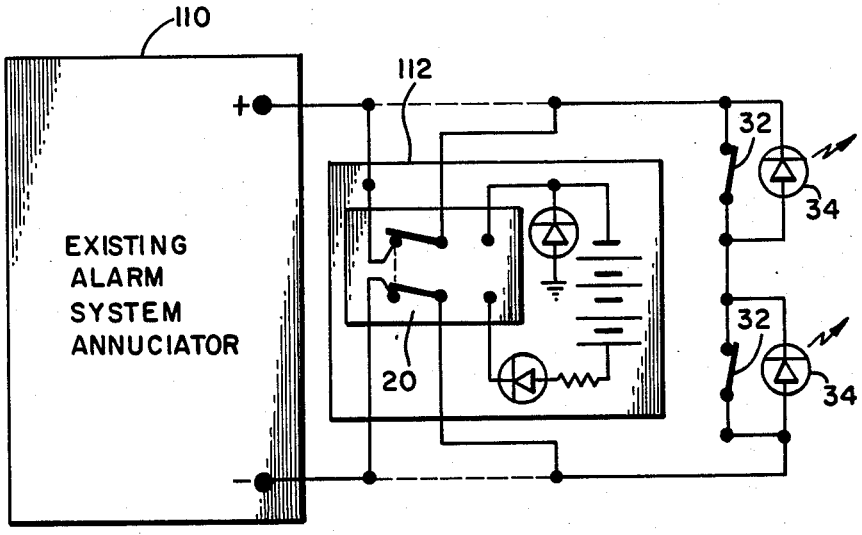
FIG. 5 is a schematic drawing of an apparatus according to the invention to be retrofit on an existing alarm system.

Unit 90 may be mounted as shown in FIG. 5 between an existing alarm system annunciator 110 and already-installed series-connected electrical contacts 32. The user need only break the connection between existing annunciator 110 and electrical contacts 32, said connections being shown in dotted lines in FIG. 5, and place a packaged test unit 112 in the line. LEDs 34 must also be installed at the individual contacts 32 at the required polarity.

In the event the individual contacts 32 are each wired back to a central location, indicator lamps or LEDs can be provided on a panel, perhaps including a diagram representing the house or other establishment, whereby the entire apparatus can be centrally installed, except for the electrical contacts 32.

The invention having been disclosed, a number of further variations will occur to persons skilled in the art. Reference should be made to the appended claims rather than the foregoing specification as indicating the true scope of the invention.

What is claimed is:

1. An alarm system, comprising:

a plurality of normally-closed electrical contacts wired in series with one another and further connected in series, when in an operating mode, with an alarm condition annunciator, each of the contacts being mountable at a location to be monitored and adapted to be opened by occurrence by an alarm condition, the annunciator being operative upon an open-circuit condition at any of said plurality of contacts, the annunciator having electrical polarizing means defining a forward current direction for the series wired contacts in the operating mode;

a plurality of individual indicator means wired one each in parallel with each of said electrical contacts, the individual indicator means having an operational bias means defining an electrical polarity opposite the electrical polarity of the annunciator, whereby a forward current flowing through the series wired contacts will not activate any of the indicator means; and, switch means operable in a test mode to disconnect the annunciator and apply to the series wired contacts a test voltage at a polarity opposite the electrical polarity of the annunciator and cause a reverse current to flow through the series wired contacts, whereby each of a plurality of electrical contacts then in said open-circuit condition is identified by activation of the individual indicator means wired in parallel therewith.

2. The alarm system of claim 1, wherein said individual indicator means comprise light-emitting diodes ("LEDs").

3. The system of claim 2, wherein the test voltage is supplied by a direct current ("DC") voltage source connectable to the electrical contacts in series with a current-limiting resistor.

4. The system of claim 3, further comprising a test condition indicator means in series with the DC voltage source, operable upon connection thereof.

5. The system of claim 3, further comprising a ground fault indicator means connected between a ground and a contact of the DC voltage source, the ground fault indicator means being activated in said test mode to indicate any connection between said contacts and said ground.

6. The system of claim 5, wherein the ground fault indicator means comprises an LED.

7. The system of claim 1, wherein said switch means is a double-pole-double-throw ("DPDT") switch, the plurality of normally-closed contacts being connected between wiper contacts of said DPDT switch and the annunciator, and the test voltage being connected to normally-closed and normally-opened contacts of said DPDT switch, respectively.

8. The system of claim 7, wherein the DPDT switch is a momentary switch.

9. The system of claim 1, wherein the individual indicator means are physically located nearby the respective electrical contacts, whereby said indicator means further indicate the physical location of an alarm condition.

10. A diagnostic apparatus for use with an alarm network the type having a plurality of normally-closed electrical contacts wired in series with one another, each contact being located at a position to be monitored, the electrical contacts being connected in series with an annunciator operable to detect an open circuit in any of the electrical contacts by a resulting cessation of a forward direct current flowing through the series wired contacts, the diagnostic apparatus comprising:

at least one indicator means connected in parallel with one of the electrical contacts, the indicator means having an operational bias means defining a polarity opposite to the polarity defined by the forward direction of the direct current through the annunciator and contacts; and, a switch operable in a test mode to disconnect the annunciator from the electrical contacts and apply to the series wired contacts an opposite-polarity test voltage to said electrical contacts and cause a reverse current to flow through the series wired contacts, whereupon the at least one indicator means is operable to show an open circuit condition in the electrical contact associated with the at least one indicator means.

11. The apparatus of claim 10, wherein the at least one indicator means comprises a light-emitting diode.

12. The apparatus of claim 10, wherein the at least one indicator means comprises a lamp in series with a diode.

13. The apparatus of claim 10, wherein the switch is a double-pole-double-throw switch, the series wired contacts being connected across the pole contacts of said switch and the annunciator and test voltage being connected across the double throw contacts, respectively.

14. The appratus of claim 10, wherein all of said contacts have an associated parallel-wired, reverse biased indicator means.

* * * * *